US008757750B2

(12) United States Patent
Banerjee et al.

(10) Patent No.: US 8,757,750 B2
(45) Date of Patent: Jun. 24, 2014

(54) CROSSTALK REDUCTION IN PIEZO PRINTHEAD

(75) Inventors: Neel Banerjee, Corvallis, OR (US); Andrew L. Van Brocklin, Corvallis, OR (US); David Pidwerbecki, Corvallis, OR (US); Christopher Reimer, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 125 days.

(21) Appl. No.: 13/384,358

(22) PCT Filed: Mar. 12, 2010

(86) PCT No.: PCT/US2010/027215

§ 371 (c)(1), (2), (4) Date: Jan. 17, 2012

(87) PCT Pub. No.: WO2011/112200

PCT Pub. Date: Sep. 15, 2011

(65) Prior Publication Data

US 2012/0120138 A1 May 17, 2012

(51) Int. Cl.
*B41J 29/38* (2006.01)
*B41J 2/045* (2006.01)

(52) U.S. Cl.
CPC ..... *B41J 2/04525* (2013.01); *B41J 2/04573* (2013.01); *B41J 2/04581* (2013.01); *B41J 2/04591* (2013.01)
USPC ..... 347/10

(58) Field of Classification Search
CPC ..... B41J 2/04573; B41J 2/04588
USPC ..... 347/9–11, 68, 70–72
See application file for complete search history.

(56) References Cited

U.S. PATENT DOCUMENTS

| | | | | |
|---|---|---|---|---|
| 5,801,732 | A | 9/1998 | Pengelly | |
| 5,815,172 | A | 9/1998 | Moh | |
| 6,280,012 | B1 | 8/2001 | Schloeman et al. | |
| 6,390,579 | B1 | 5/2002 | Roylance et al. | |
| 6,439,679 | B1 | 8/2002 | Roylance | |
| 6,719,390 | B1 | 4/2004 | Howkins et al. | |
| 6,998,928 | B2 | 2/2006 | Stengel et al. | |
| 7,387,353 | B2 | 6/2008 | Saksa | |
| 7,448,708 | B2 | 11/2008 | Nakayama | |
| 8,348,374 | B2 * | 1/2013 | Kusunoki | 347/14 |
| 2009/0085434 | A1 | 4/2009 | Ishii et al. | |
| 2009/0085435 | A1 | 4/2009 | Sekiguchi | |

FOREIGN PATENT DOCUMENTS

| | | |
|---|---|---|
| JP | 2001287347 | 10/2001 |
| JP | 2006123397 | 5/2006 |

* cited by examiner

*Primary Examiner* — An Do
(74) *Attorney, Agent, or Firm* — Nathan R. Rieth

(57) ABSTRACT

Crosstalk in a piezo printhead is reduced by selecting an actuation signal for a nozzle, determining a time delay and a pulse width extension based on adjacent actuation signals of adjacent nozzles, and applying the time delay and pulse width extension to the actuation signal.

20 Claims, 11 Drawing Sheets

Pulse Width Extension Element Logic Flow

CROSSTALK REDUCTION IN PIEZO PRINTHEAD

This application is a Nation Stage 371 of PCT/US10/27215 filed on Mar. 12, 2010.

BACKGROUND

Drop on demand (DOD) piezo printheads are utilized widely to print on a variety of substrates. Piezo printheads are favored versus thermal inkjet printheads when using jetable materials such as UV curable printing inks whose higher viscosity or chemical composition prohibits the use of thermal inkjet for their DOD application. Thermal inkjet printheads use a heating element actuator in an ink-filled chamber to vaporize ink and create a bubble which forces an ink drop out of a nozzle. Thus, the jetable materials suitable for use in thermal inkjet printheads are limited to those whose formulations can withstand boiling temperature without mechanical or chemical degradation. Piezo printheads can accommodate a wider selection of jetable materials, however, as they use a piezoelectric material actuator on a membrane of an ink-filled chamber to generate a pressure pulse which forces a drop of ink out of the nozzle.

However, one problem that piezoelectric printheads have is mechanical crosstalk between adjacent nozzles. When the membrane in a given nozzle moves up, the membrane in adjacent nozzles moves down by some lesser distance. This affects the operation of the adjacent nozzles negatively. Ideally, when a given nozzle is actuated (moving its membrane up or down), the membrane in adjacent nozzles would not be affected. Rather, the membrane in adjacent nozzles would be completely independent and would not move detectably when neighboring nozzles are actuated and their membrane moves.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
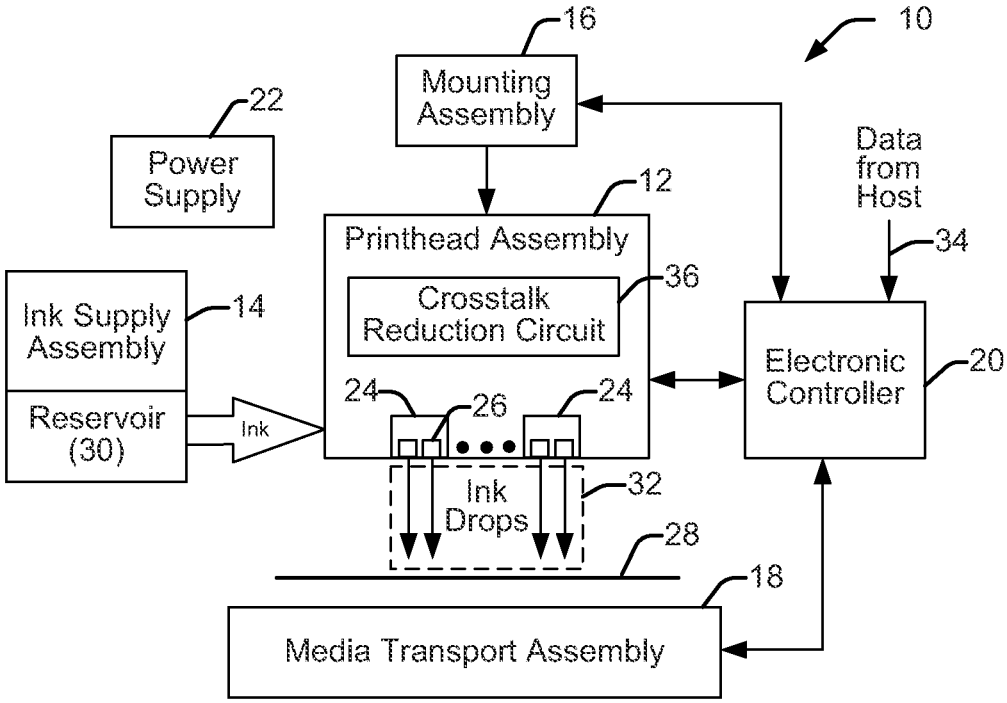
FIG. 1 shows an inkjet printing system according to an embodiment.

As noted above, mechanical crosstalk between adjacent nozzles in a piezoelectric printhead has an adverse effect on the operation of the printhead. Mechanical crosstalk occurs primarily through a common mechanical membrane that moves in response to applied voltages to a connected piezoelectric material. The membrane is often made of a relatively thick sheet of silicon that begins as a wafer of about 675-700 microns and then ground down to about 20-50 microns. The membrane is shared by tightly packed fluid chambers and is stiff in order to accommodate a high frequency of drop ejection. The tightly packed chambers and stiffness of the membrane cause mechanical crosstalk between adjacent nozzles as movement in the membrane at one nozzle pulls against the membrane in adjacent nozzles. Actuation of a nozzle causes the membrane at that nozzle to deflect in a direction that decreases the volume of the chamber and forces a drop out of the nozzle. The membrane displacement at the actuated nozzle results in undesired displacement in an opposite direction of the membrane in adjacent nozzles (i.e., mechanical crosstalk). The resulting volume changes in adjacent chambers caused by the undesired membrane displacement may adversely affect the drop ejection process in the adjacent chambers.

Previous solutions to the problem of mechanical crosstalk between adjacent nozzles in piezoelectric printheads include idling every other nozzle such that an idle chamber is present between every two active nozzles. Thus, the printhead fires only every other nozzle at once. The main disadvantage with this approach is that the printhead productivity/speed is reduced by half. Thus, twice the number of printheads would be necessary in a printer implementing this solution to achieve the same print speed in a printer not needing such a solution.

Other partial solutions include cutting the piezo material completely between nozzles and/or thinning the membrane. However, the additional process steps needed to completely cut the piezo material between nozzles add significant costs. When thinning the membrane, limitations in the machinery available to grind the membrane necessitate minimum membrane thicknesses in order to provide a consistent yield.

Embodiments of the present disclosure overcome disadvantages such as those mentioned above, generally by adjusting the timing and duration of an actuation voltage signal driving each nozzle. An actuation signal is selected from a previous nozzle actuation signal, a next nozzle actuation signal, or a common (global or local) actuation signal. A time delay element and pulse width extension element modify the timing and pulse duration of the selected actuation signal based on the status of actuation signals of neighboring nozzles. Applying an appropriate time delay and pulse width extension to a nozzle actuation signal reduces mechanical crosstalk between adjacent nozzles by decreasing the time that adjacent nozzle actuators are active at the same time and by maintaining drop velocity stability.

In one embodiment, for example, a method to reduce crosstalk in a piezo printhead includes selecting an actuation signal for a nozzle, determining a time delay and pulse width extension based on adjacent actuation signals of adjacent nozzles, and applying the time delay and pulse width extension to the actuation signal. The time delay and pulse width extension are retrieved from registers determined based on a binary firing status of a previous and a next nozzle actuation signal.

In another example embodiment, a circuit for reducing crosstalk in a piezo printhead includes a time delay element to select a time delay based on actuation signal values of adjacent nozzles, and to apply the time delay to an actuation signal of a current nozzle. The time delay element retrieves the time delay from a time delay register. The circuit also includes a pulse width extension element to select a pulse width extension based on the actuation signal values of the adjacent nozzles and to apply the pulse width extension to the actuation signal of the current nozzle. The pulse width extension element retrieves the pulse width extension from a pulse width extension register.

In another example embodiment, a crosstalk reduction system includes a piezo printhead having an array of nozzles, a movable membrane to eject a jetable material through a nozzle by adjusting volume in an associated nozzle chamber, a piezoelectric material to move the membrane by application of an actuation voltage signal to the piezoelectric material, and a nozzle circuit associated with each of the nozzles that includes a time delay element to delay the actuation voltage signal based on adjacent actuation voltage signals of adjacent nozzles. The system also includes a pulse width extension element to extend the pulse width of the actuation voltage signal based on the adjacent actuation voltage signals.

Illustrative Embodiments

FIG. 1 illustrates one embodiment of an inkjet printing system 10. Inkjet printing system 10 includes an inkjet printhead assembly 12, an ink supply assembly 14, a mounting assembly 16, a media transport assembly 18, an electronic controller 20, and at least one power supply 22 which provides power to the various electrical components of inkjet printing system 10. Inkjet printhead assembly 12 includes at least one printhead or printhead die 24 that ejects drops of ink through a plurality of orifices or nozzles 26 and toward a print medium 28 so as to print onto print medium 28. Print medium 28 is any type of suitable sheet material, such as paper, card stock, transparencies, Mylar, and the like. Typically, nozzles 26 are arranged in one or more columns or arrays such that properly sequenced ejection of ink from nozzles 26 causes characters, symbols, and/or other graphics or images to be printed upon print medium 28 as inkjet printhead assembly 12 and print medium 28 are moved relative to each other.

Ink supply assembly 14 supplies ink to printhead assembly 12 and includes a reservoir 30 for storing ink. Ink flows from reservoir 30 to inkjet printhead assembly 12, and ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. Ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 30 of ink supply assembly 14 may be removed, replaced, and/or refilled. In one embodiment, where inkjet printhead assembly 12 and ink supply assembly 14 are housed together in an inkjet cartridge, reservoir 30 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18, and media transport assembly 18 positions print medium 28 relative to inkjet printhead assembly 12. Thus, a print zone 32 is defined adjacent to nozzles 26 in an area between inkjet printhead assembly 12 and print medium 28. In one embodiment, inkjet printhead assembly 12 is a scanning type printhead assembly. As such, mounting assembly 16 includes a carriage for moving inkjet printhead assembly 12 relative to media transport assembly 18 to scan print medium 28. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 28 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 34 from a host system, such as a computer, and includes memory for temporarily storing data 34. Typically, data 34 is sent to inkjet printing system 10 along an electronic, infrared, optical, or other information transfer path. Data 34 represents, for example, a document and/or file to be printed. As such, data 34 forms a print job for inkjet printing system 10 and includes one or more print job commands and/or command parameters.

In one embodiment, electronic controller 20 controls inkjet printhead assembly 12 for ejection of ink drops from nozzles 26. Thus, electronic controller 20 defines a pattern of ejected ink drops which form characters, symbols, and/or other graphics or images on print medium 28. The pattern of ejected ink drops is determined by the print job commands and/or command parameters.

In one embodiment, inkjet printhead assembly 12 includes one printhead 24. In another embodiment, inkjet printhead assembly 12 is a wide-array or multi-head printhead assembly. In one wide-array embodiment, inkjet printhead assembly 12 includes a carrier which carries printhead dies 24, provides electrical communication between printhead dies 24 and electronic controller 20, and provides fluidic communication between printhead dies 24 and ink supply assembly 14.

Figure 2:
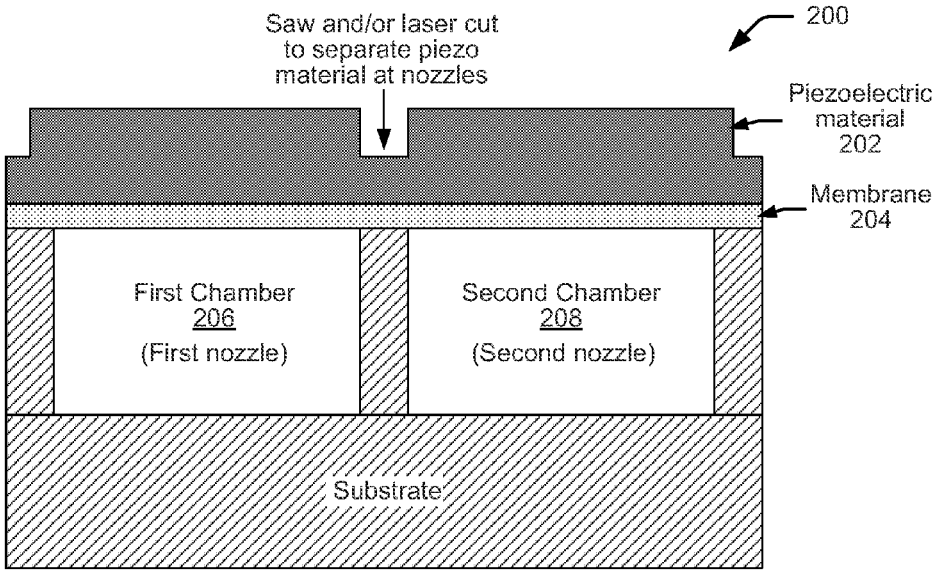
FIG. 2 shows piezoelectric side shooter chambers in a printhead assembly according to an embodiment.

In one embodiment, inkjet printing system 10 is a drop-on-demand piezoelectric inkjet printing system 10. As such, a piezoelectric printhead assembly 12 includes a crosstalk reduction circuit 36, discussed in greater detail herein below. A piezoelectric printhead assembly 12 in a piezoelectric inkjet printing system 10 includes piezo chambers formed in a printhead die 24, such as the piezo side shooter chambers 200 illustrated in FIG. 2. In the piezo side shooter chambers 200 of FIG. 2, no actuation of the piezo material 202 is taking place. The membrane 204 is configured to move up and down to increase and decrease the volume of individual chambers (e.g., First Chamber 206, Second Chamber 208), and the jetable material (e.g., ink) ejects out of the page toward the viewer. The refill structure (not shown) is behind the chambers 206, 208, and the nozzle structure (not shown) is in front of the chambers, toward the viewer.

Figure 3:
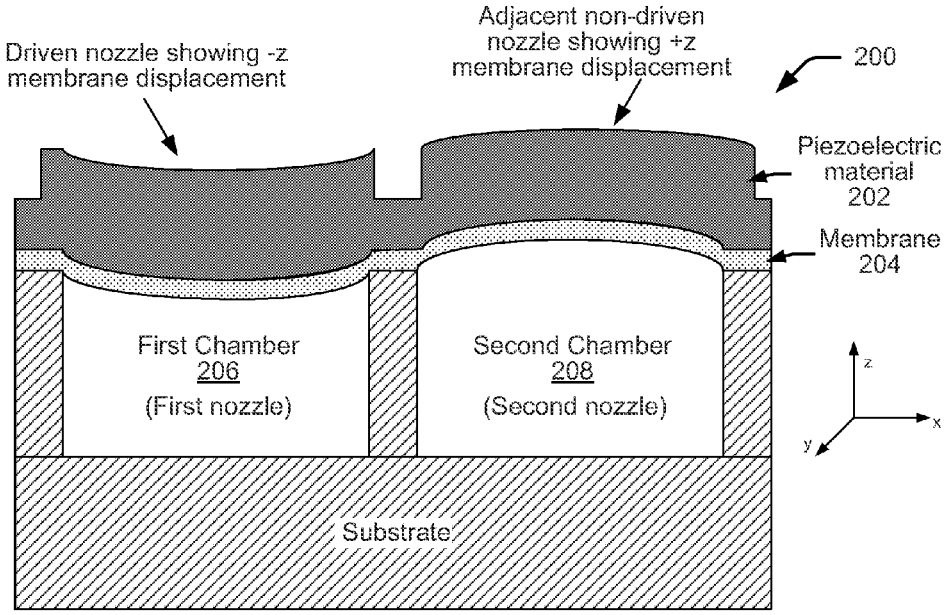
FIG. 3 shows the actuation of a piezo chamber through the application of a voltage to piezoelectric material according to an embodiment.

Actuation of a piezo chamber 206, 208, occurs when an actuation voltage signal is applied to the piezoelectric material 202 associated with the chamber. FIG. 3 illustrates the actuation of the first chamber 206 (i.e., driving of the first nozzle) through the application of an actuation voltage signal to the piezoelectric material 202 above the first chamber 206. Actuation of the piezoelectric material 202 causes the piezo material 202 to deform in the −z direction which results in a corresponding displacement of the adjoining membrane 204 in the −z direction (the deformation and displacement are exaggerated in the illustration for the purpose of this description). Displacement of the membrane 204 into the chamber 206 reduces the chamber volume, causing the ejection of a drop of ink from the first chamber 206, through the first nozzle (not shown).

FIG. 3 further illustrates the well-known effect of mechanical crosstalk between adjacent piezo chambers (e.g., chambers 206, 208). As the membrane 204 over the first chamber 206 displaces in the −z direction during the actuation of the first nozzle, it pulls against the membrane (i.e., the membrane pulls against itself) over adjacent chambers, such as the adjacent second chamber 208 shown in FIG. 3. This pulling causes the membrane 204 over adjacent chambers to displace in the opposite direction (i.e., +z direction). Since the amount of crosstalk affecting a given nozzle is a contribution of crosstalk from all adjacent nozzles, the crosstalk magnitude for a given nozzle is the sum of the contributions from all the adjacent nozzles. For example, in FIGS. 1 and 2 there are only two adjacent nozzles for any given nozzle due to the linear nature of the example array illustrated. In such a linear array of nozzles, assuming a crosstalk coefficient of 0.15 describes the amount of crosstalk to affect a given nozzle from an applied movement in an adjacent nozzle, the total possible crosstalk in a given nozzle would be 2*15%=30% crosstalk. Thus, in a line of 3 adjacent nozzles where the outer 2 nozzles are driven simultaneously to an arbitrary membrane displacement of 1, the middle nozzle membrane experiences a membrane displacement of −0.3. In one case of a 2-dimensional array of nozzles, for example, where each nozzle has 4 adjacent nozzles, a crosstalk coefficient of 0.15 creates a total possible crosstalk in a given nozzle of 4*15%=60%.

Figure 4:
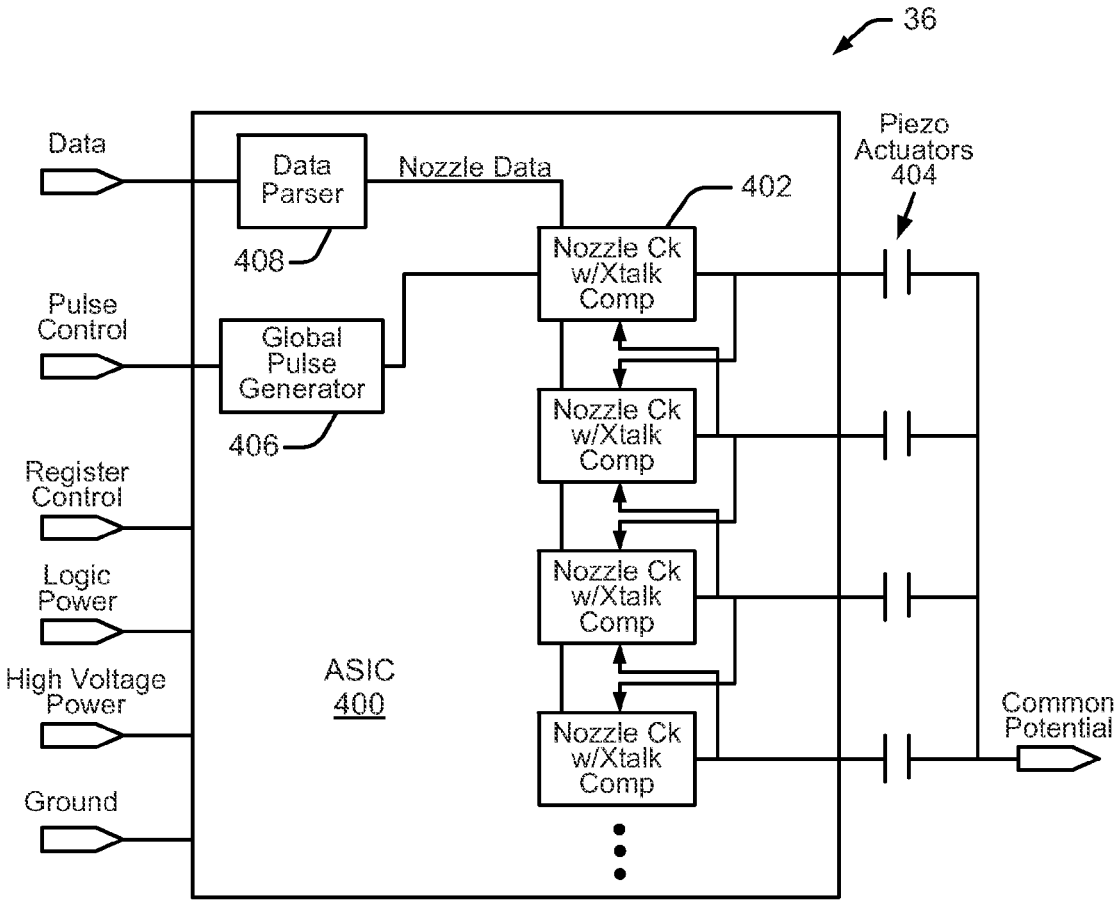
FIG. 4 shows a crosstalk reduction circuit in a piezoelectric printhead assembly according to an embodiment.

FIG. 4 illustrates one embodiment of a crosstalk reduction circuit 36 in a piezoelectric printhead assembly 12 such as that shown in FIG. 1. Although the crosstalk reduction circuit 36 of FIG. 4 is embodied as an application specific integrated circuit (ASIC) 400, it is not limited to such an ASIC implementation. Rather, crosstalk reduction circuit 36 may be configured in other ways. For example, elements of crosstalk reduction circuit 36 (discussed in greater detail below) may be implemented as integrated circuitry fabricated onto the printhead substrate through various precision microfabrication techniques such as electroforming, laser ablation, anisotropic etching, and photolithography.

Referring to FIG. 4, crosstalk reduction circuit 36 includes a plurality of nozzle circuits 402. Each nozzle circuit 402 is associated with a piezoelectric actuator 404 of a particular nozzle 26 (FIG. 1). Crosstalk reduction circuit 36 includes global pulse generator 406 to supply a global actuation signal to nozzle circuits 402 and data parser 408 to supply parsed nozzle data to circuits 402. Crosstalk reduction circuit 36 also includes Data, Pulse Control and Register Control inputs, generally from a controller such as electronic controller 20. Crosstalk reduction circuit 36 also includes logic and high voltage power inputs and a ground connection.

Figure 5:
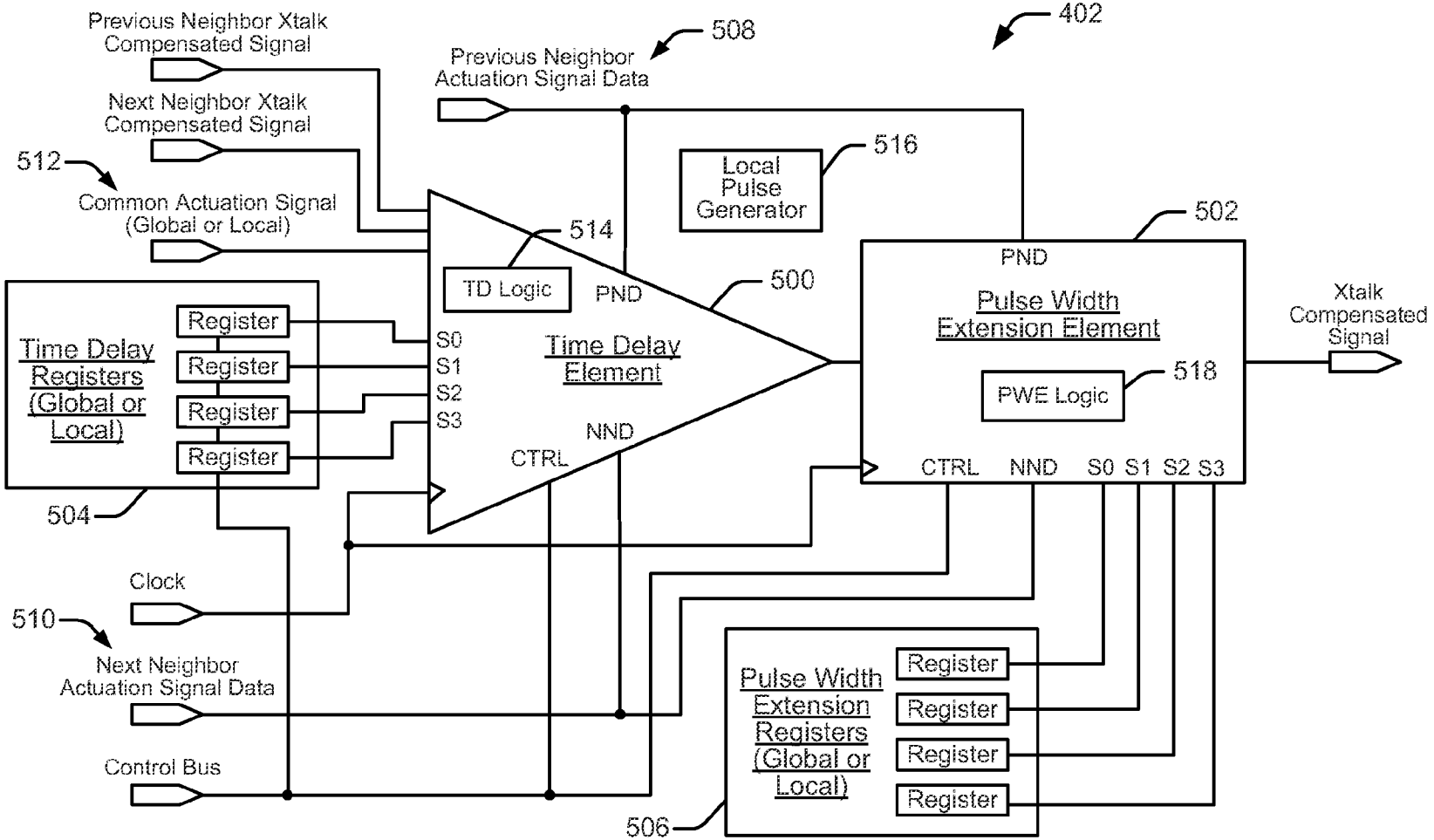
FIG. 5 shows a nozzle circuit according to an embodiment.

FIG. 5 illustrates a nozzle circuit 402 and its elements in greater detail. Nozzle circuit 402 includes a time delay element 500 and a pulse width extension element 502. Both the time delay element 500 and pulse width extension element 502 are variable in that the amount of time delay and pulse width extension are selectable, respectively, from time delay registers 504 and pulse width extension registers 506. Time delay element 500 is generally configured to select a time delay and apply the time delay to an actuation signal of a current nozzle. Pulse width extension element 502 is generally configured to select a pulse width extension and apply the pulse width extension to the actuation signal of the current nozzle.

Nozzle circuit 402 also includes a previous neighbor (i.e., previous nozzle) actuation signal data input 508, a next neighbor (i.e., next nozzle) actuation signal data input 510, and a common (global or local) actuation signal data input 512. The previous neighbor actuation signal input 508, next neighbor actuation signal input 510, and common actuation signal input 512 are all coupled to time delay element 500, while only the previous neighbor actuation signal input 508 and next neighbor actuation signal input 510 are coupled to the pulse width extension element 502. Nozzle circuit 402 also includes clock and control bus inputs coupled to time delay element 500 and pulse width extension element 502, and previous neighbor and next neighbor crosstalk compensated signal inputs coupled to time delay element 500.

Figure 6:
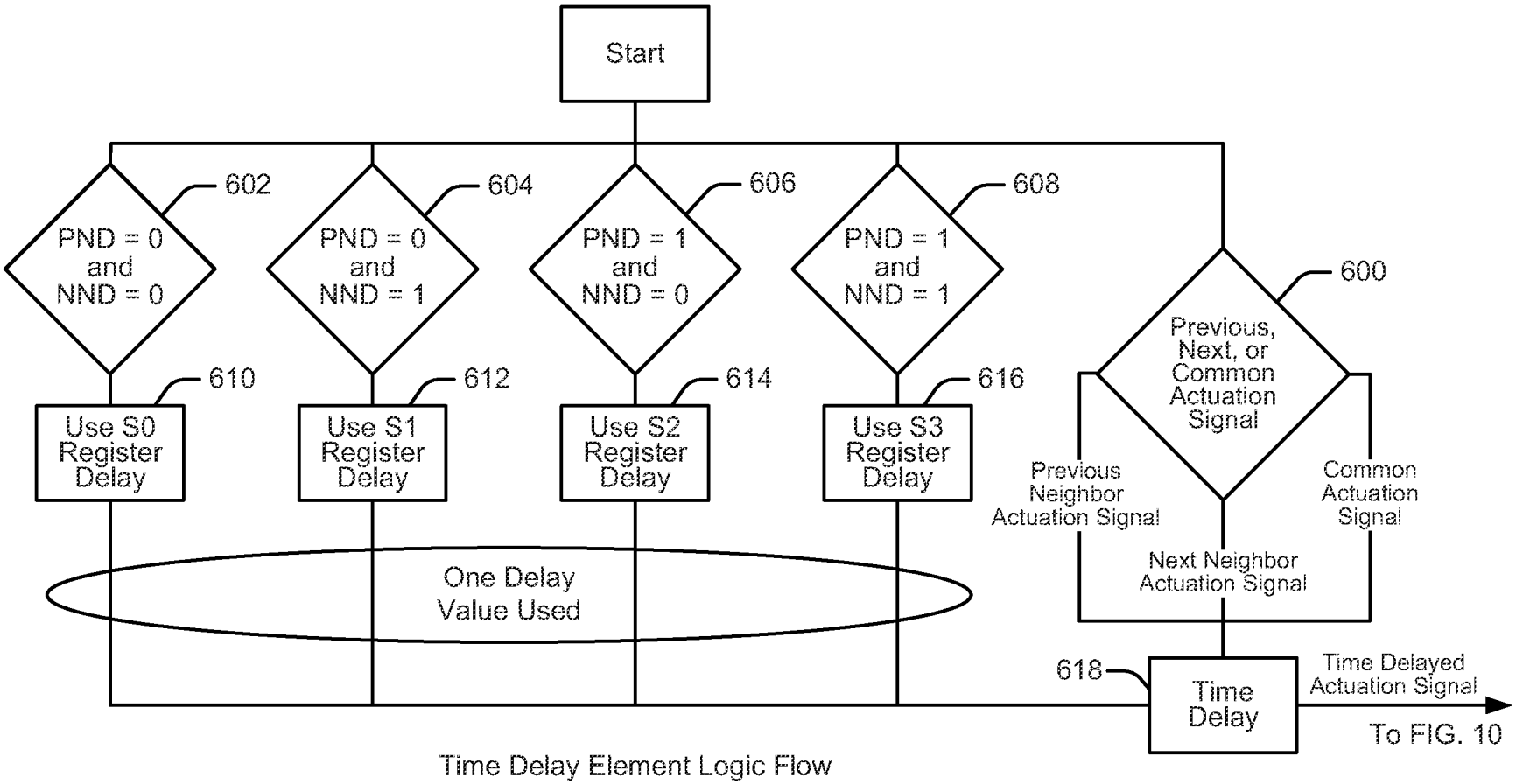
FIG. 6 shows the logic flow of a time delay element according to an embodiment.

Time delay element 500 includes time delay logic 514, which performs several functions within time delay element 500. The time delay element logic flow shown in FIG. 6 helps to illustrate the time delay logic 514 functions. The logic flow of FIG. 6 is applicable to any given nozzle, each time that nozzle is fired. For example, as shown at decision block 600, using time delay logic 514, the time delay element 500 selects either the previous neighbor actuation signal 508, the next neighbor actuation signal 510, or the common actuation signal 512 as the actuation signal to drive a current nozzle (i.e., the nozzle associated with the particular nozzle circuit 402). The common actuation signal 512 can be a global actuation signal generated, for example, by a global pulse generator 406 located outside of nozzle circuit 402, or it can be a local actuation signal generated within the nozzle circuit 402 by a local pulse generator 516.

In addition to selecting the source of the actuation signal to drive the nozzle, time delay logic 514 also selects which time delay to apply to the actuation signal from one of the time delay registers 504. Time delay registers 504 may be preloaded with time base delay units at the factory during manufacturing, for example, or they may be dynamically loaded just prior to every actuation of the nozzle by the printing system 10 through electronic controller 20. As indicated by decision blocks 602, 604, 606, and 608, time delay logic 514 monitors the binary firing status indicated by the previous neighbor actuation signal data 508 (PND) and the next neighbor actuation signal data 510 (NND), and determines which one of the four time delay registers 504 from which to retrieve the time delay. For example, if both the PND and NND are 0 (i.e., indicating both the previous neighbor nozzle and the next neighbor nozzle are not firing) then the time delay amount will be retrieved from time delay register S0 (610). Similarly, for PND and NND firing data of 0 and 1, the time delay retrieved is from register S1 (612); for PND and NND firing data of 1 and 0, the time delay retrieved is from register S2 (614); and for PND and NND firing data of 1 and 1, the time delay retrieved is from register S3 (616). Once the time delay logic 514 selects the appropriate time delay based on the previous and next neighbor firing status data, it applies the time delay 618 to the actuation signal resulting in a delayed actuation signal.

Figure 7:
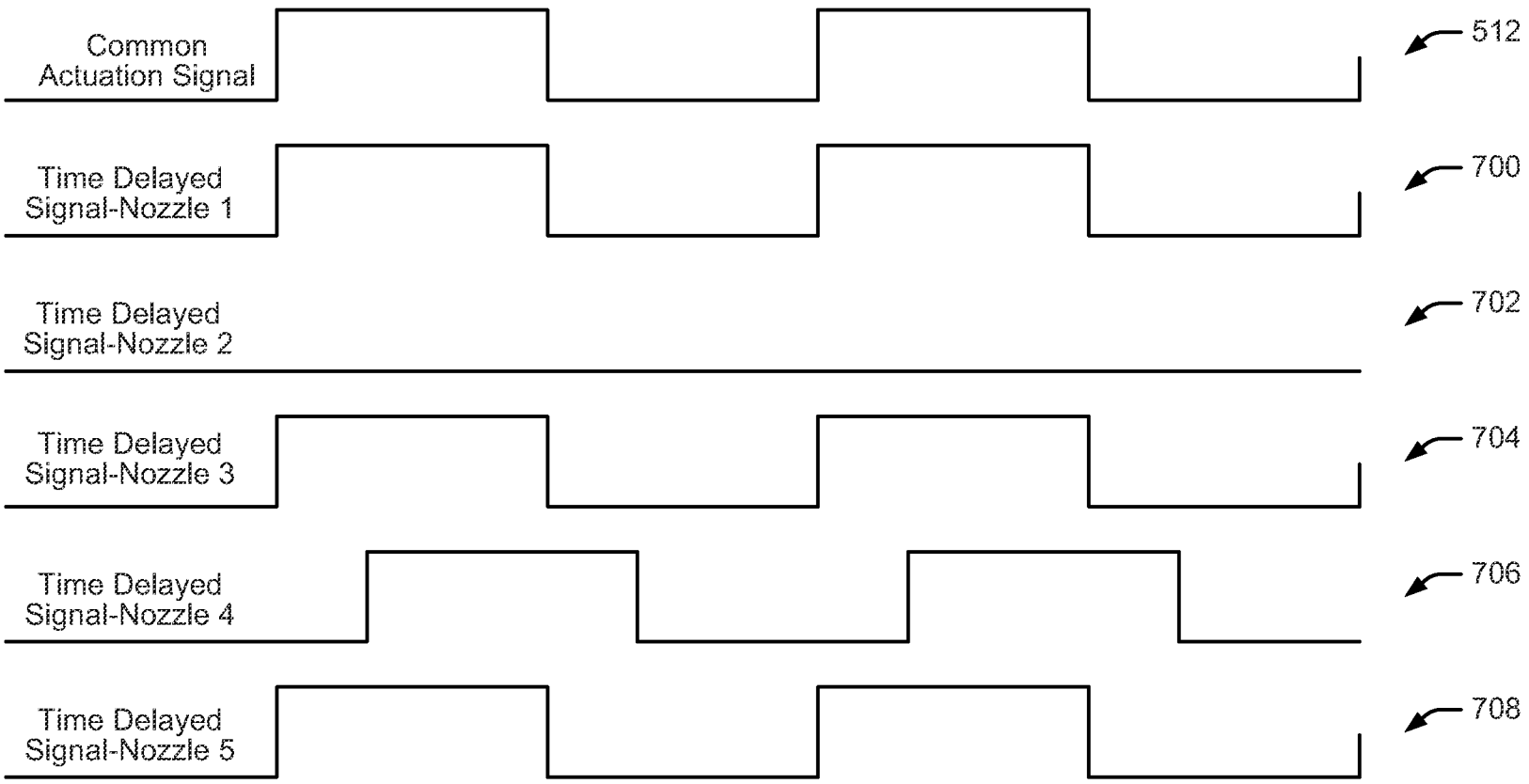
FIG. 7 shows time delayed actuation waveforms according to an embodiment.

FIG. 7 shows an example of delayed actuation waveforms which help illustrate the FIG. 6 time delay logic flow process for delaying the actuation signal. In the example waveforms of FIG. 7 a simplified linear 5 nozzle design is assumed, where the $1^{st}$, $3^{rd}$, $4^{th}$ and $5^{th}$ nozzles are to fire while nozzle 2 does not fire. It is further assumed that the time delay registers (504) of S0, S1, and S2 contain zero time delay base units, while the S3 register contains 3 time delay base units (for the purpose of this discussion, the time delay base units used in this example are assumed to be unitless, but could otherwise be any appropriate amount of time delay). Furthermore, as the FIG. 7 waveforms indicate, the time delay logic 514 selects the common actuation signal 512 as the actuation drive signal. Referring to the time delay element logic flow of FIG. 6, since nozzle 1 has only a next neighbor and not a previous neighbor, the PND is assumed to be 0. In addition, nozzle 2 is not firing as noted above, and the NND is therefore also 0. Accordingly, with the binary firing status of the previous and next neighbor actuation data being 0 for both PND and NND, decision block 602 of the logic flow of FIG. 6 shows that the S0 time delay register is used (610) as the time delay register 504 from which to retrieve the time delay that will be applied to the nozzle 1 actuation signal. Since the S0 time delay register contains zero time delay base units, the nozzle 1 actuation signal does not need to be delayed. Thus, the resulting time delayed, nozzle 1 actuation signal 700 receives no time delay crosstalk compensation and precisely tracks the common actuation drive signal 512.

Continuing on with the actuation waveforms of FIG. 7, since nozzle 2 is not firing, its corresponding time delayed, nozzle 2 actuation signal 702 is also not firing. For nozzle 3, the PDN is 0 (i.e., previous neighbor nozzle 2 is not firing) and the NND is 1 (i.e., next neighbor nozzle 4 is firing). Decision block 604 of the logic flow of FIG. 6 indicates that the S1 time delay register is used (612) as the time delay register 504 from which to retrieve the time delay that will be applied to the nozzle 3 actuation signal. Since the S1 time delay register contains zero time delay base units, the nozzle 3 actuation signal does not need to be delayed. Thus, the resulting time delayed, nozzle 3 actuation signal 704 receives no time delay crosstalk compensation and precisely tracks the common actuation drive signal 512. For nozzle 4, the PDN is 1 (i.e., previous neighbor nozzle 3 is firing) and the NND is 1 (i.e., next neighbor nozzle 5 is firing). Decision block 608 of the logic flow of FIG. 6 indicates that the S3 time delay register is used (616) as the time delay register 504 from which to retrieve the time delay that will be applied to the nozzle 4 actuation signal. Since the S3 time delay register contains three time delay base units, the nozzle 4 actuation signal needs to be delayed. Thus, the resulting time delayed, nozzle 4 actuation signal 706 receives a three unit time delay crosstalk compensation with respect to the common actuation drive signal 512. For nozzle 5, the PDN is 1 (i.e., previous neighbor nozzle 4 is firing) and the NND is 0 (i.e., since there is no next neighbor, the NND is assumed to be 0). Decision block 606 of the logic flow of FIG. 6 indicates that the S2 time delay register is used (614) as the time delay register 504 from which to retrieve the time delay that will be applied to the nozzle 5 actuation signal. Since the S2 time delay register contains zero time delay base units, the nozzle 5 actuation signal does not need to be delayed. Thus, the resulting time delayed, nozzle 5 actuation signal 708 receives no time delay crosstalk compensation and precisely tracks the common actuation drive signal 512.

Figure 8:
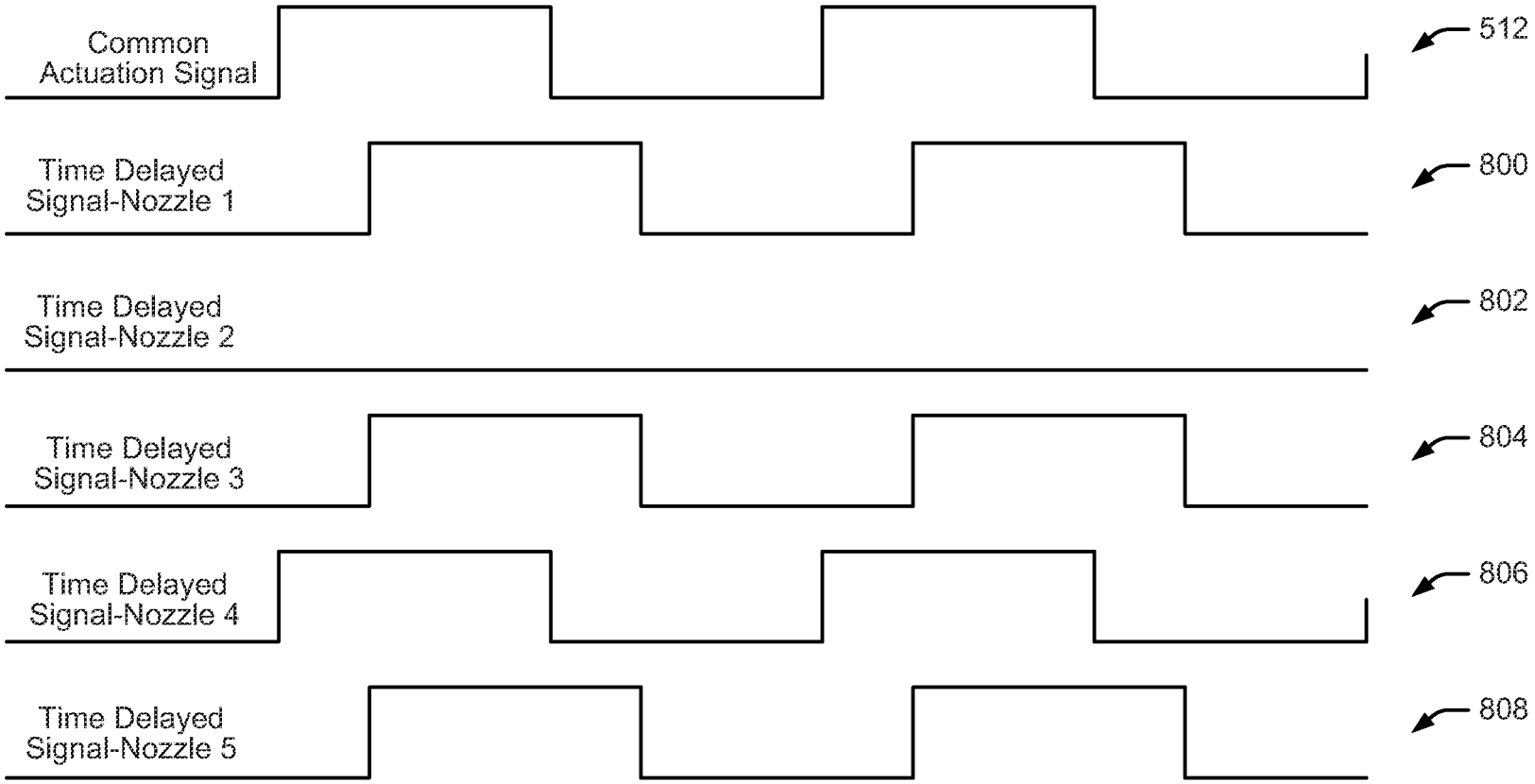
FIG. 8 shows an actuation waveform that is negatively delayed relative to other actuation waveforms according to an embodiment.

FIG. 8 shows an example of an actuation waveform that is relatively negatively delayed. The example is similar to the example discussed above for FIG. 7, with a simplified linear 5 nozzle design assumed, where the $1^{st}$, $3^{rd}$, $4^{th}$, and $5^{th}$ nozzles are to fire while nozzle 2 does not fire. However, in this example time delay registers (504) of S0, S1, and S2 contain three time delay base units, while the S3 register contains zero time delay base units. For nozzle 1, the PDN is 0 (i.e., since there is no previous neighbor, the PND is assumed to be 0) and the NND is 0 (i.e., next neighbor nozzle 2 is not firing). Decision block 602 of the logic flow of FIG. 6 indicates that the S0 time delay register is used (610) as the time delay register 504 from which to retrieve the time delay that will be applied to the nozzle 1 actuation signal. Since the S0 time delay register in the FIG. 8 example contains three time delay base units, the nozzle 1 actuation signal needs to be delayed. Thus, the resulting time delayed, nozzle 1 actuation signal 800 receives a three unit time delay crosstalk compensation with respect to the common actuation drive signal 512. As in the FIG. 7 example, since nozzle 2 is not firing, its corresponding time delayed, nozzle 2 actuation signal 802 is also not firing. For nozzle 3, the PDN is 0 and the NND is 1. This results in the selection of the S1 time delay register which contains three time delay base units. Thus, the resulting time delayed, nozzle 3 actuation signal 804 receives a three unit time delay crosstalk compensation with respect to the common actuation drive signal 512.

Nozzle 4 illustrates the relative negative time delay. For nozzle 4, both the PDN and NND are 1 since both the previous nozzle 3 and next nozzle 5 are firing. Decision block 608 of the logic flow of FIG. 6 indicates that the S3 time delay register is used (616) as the time delay register 504 from which to retrieve the time delay that will be applied to the nozzle 4 actuation signal. Since the S3 time delay register in the FIG. 8 example contains zero time delay base units, the nozzle 4 actuation signal does not need to be delayed. Thus, the resulting time delayed, nozzle 4 actuation signal 806 receives no time delay crosstalk compensation and precisely tracks the common actuation drive signal 512. However, as illustrated in FIG. 8, the time delayed, nozzle 4 actuation signal 806 has effectively been negatively delayed with respect to the time delayed actuation signals of the other nozzles.

For nozzle 5, the PDN is 1 (i.e., previous neighbor nozzle 4 is firing) and the NND is 0 (i.e., since there is no next neighbor, the NND is assumed to be 0). Decision block 606 of the logic flow of FIG. 6 indicates that the S2 time delay register is used (614) as the time delay register 504 from which to retrieve the time delay that will be applied to the nozzle 5 actuation signal. Since the S2 time delay register contains three time delay base units, the nozzle 5 actuation signal needs to be delayed. Thus, the resulting time delayed, nozzle 5 actuation signal 808 receives a three unit time delay crosstalk compensation with respect to the common actuation drive signal 512.

Referring again to FIG. 5, the input to the pulse width extension element 502 is the output from the time delay element 500. Thus, following the application of a time delay to the nozzle actuation signal by time delay element 500, the pulse width extension element 502 applies a pulse width extension to the time delayed actuation signal. The pulse width extension element 502 includes pulse width extension (PWE) logic 518. PWE logic 518 is configured to select which pulse width extension from pulse width extension registers 506 to apply to the time delayed actuation signal. The pulse width extension registers 506 define the amount of time to extend the incoming time delayed actuation signal based on the neighboring nozzle data. Similar to time delay registers 504, pulse width extension registers 506 may be pre-loaded with pulse width extension units at the factory during manufacturing, for example, or they may be dynamically loaded just prior to every actuation of the nozzle by the printing system 10 through electronic controller 20.

Figure 9:
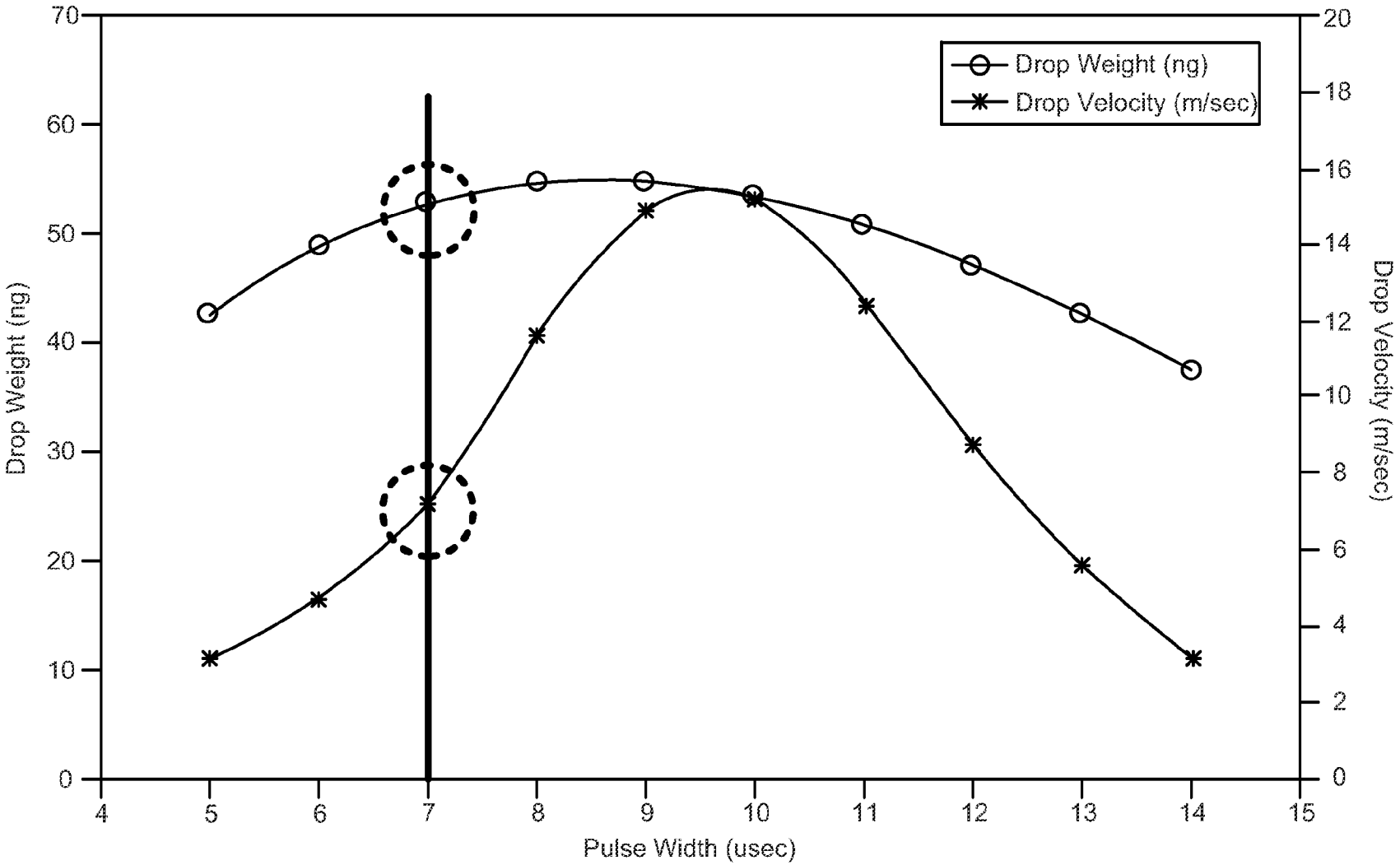
FIG. 9 shows a graph that plots the pulse width of an actuation signal versus drop velocity and drop weight according to an embodiment.

The graph in FIG. 9 shows the pulse width of an actuation signal versus drop velocity and drop weight. The graph illustrates how controlling the actuation signal pulse width controls the variability of the drop velocity. The FIG. 9 graph thus provides a way to calculate an approximate pulse width correction factor that can be used to adjust drop velocity to compensate for crosstalk effects from neighboring nozzles. For example, assume that with 25% crosstalk from neighboring nozzles, the drop velocity of a given nozzle is decreased from a nominal value of 7 m/s to 6 m/s. Using the FIG. 9 graph an approximate pulse width correction factor can be determined that will increase the drop velocity back to the nominal value of 7 m/s. As the graph indicates, an approximate pulse width correction factor of 0.46 usec will increase the drop velocity back to the nominal value of 7 m/s.

Figure 10:
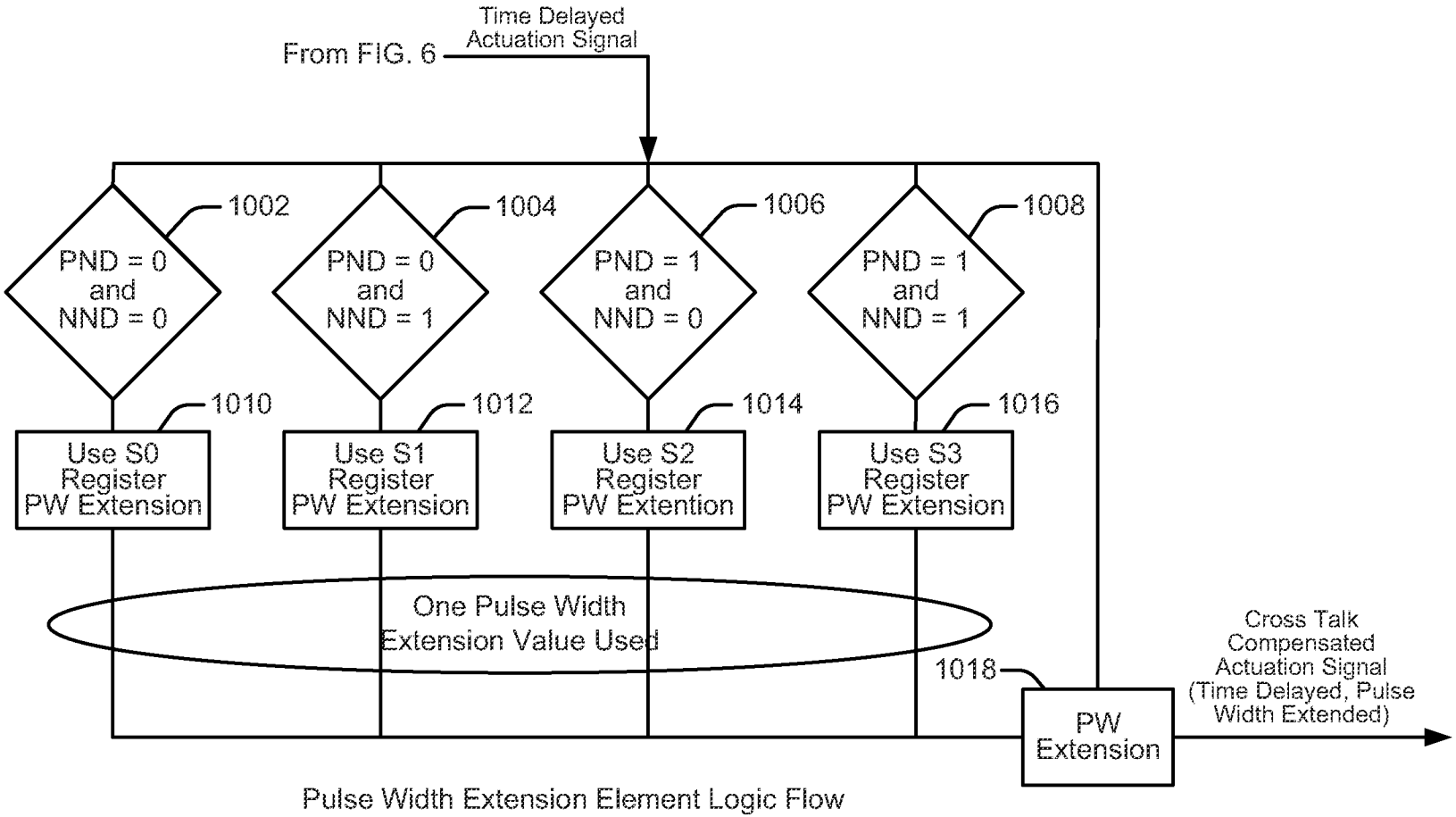
FIG. 10 shows the logic flow of a pulse width extension element according to an embodiment.

The pulse width extension element logic flow shown in FIG. 10 helps to illustrate the PWE logic 518 functions. As is apparent from the pulse width extension element logic flow of FIG. 10, the PWE logic 518 selects pulse width extensions from pulse width extension registers 506 in the same way as the TD logic 514 selects which time delay to apply to the actuation signal from time delay registers 504. Accordingly, as indicated by decision blocks 1002, 1004, 1006, and 1008, PWE logic 518 monitors the binary firing status indicated by the previous neighbor actuation signal data 508 (PND) and the next neighbor actuation signal data 510 (NND), and determines which one of the four pulse width extension registers 506 from which to retrieve the pulse width extension. For example, if both the PND and NND are 0 (i.e., indicating both the previous neighbor nozzle and the next neighbor nozzle are not firing) then the pulse width extension value will be retrieved from pulse width extension register S0 (1010). Similarly, for PND and NND firing data of 0 and 1, the pulse width extension retrieved is from register S1 (1012); for PND and NND firing data of 1 and 0, the pulse width extension retrieved is from register S2 (1014); and for PND and NND firing data of 1 and 1, the pulse width extension retrieved is from register S3 (1016). Once the PWE logic 518 selects the appropriate pulse width extension based on the previous and next neighbor firing status data, it applies the pulse width extension at 1018 to the time delayed actuation signal, resulting in a crosstalk compensated actuation signal that has been both time delayed and pulse width extended.

Figure 11:
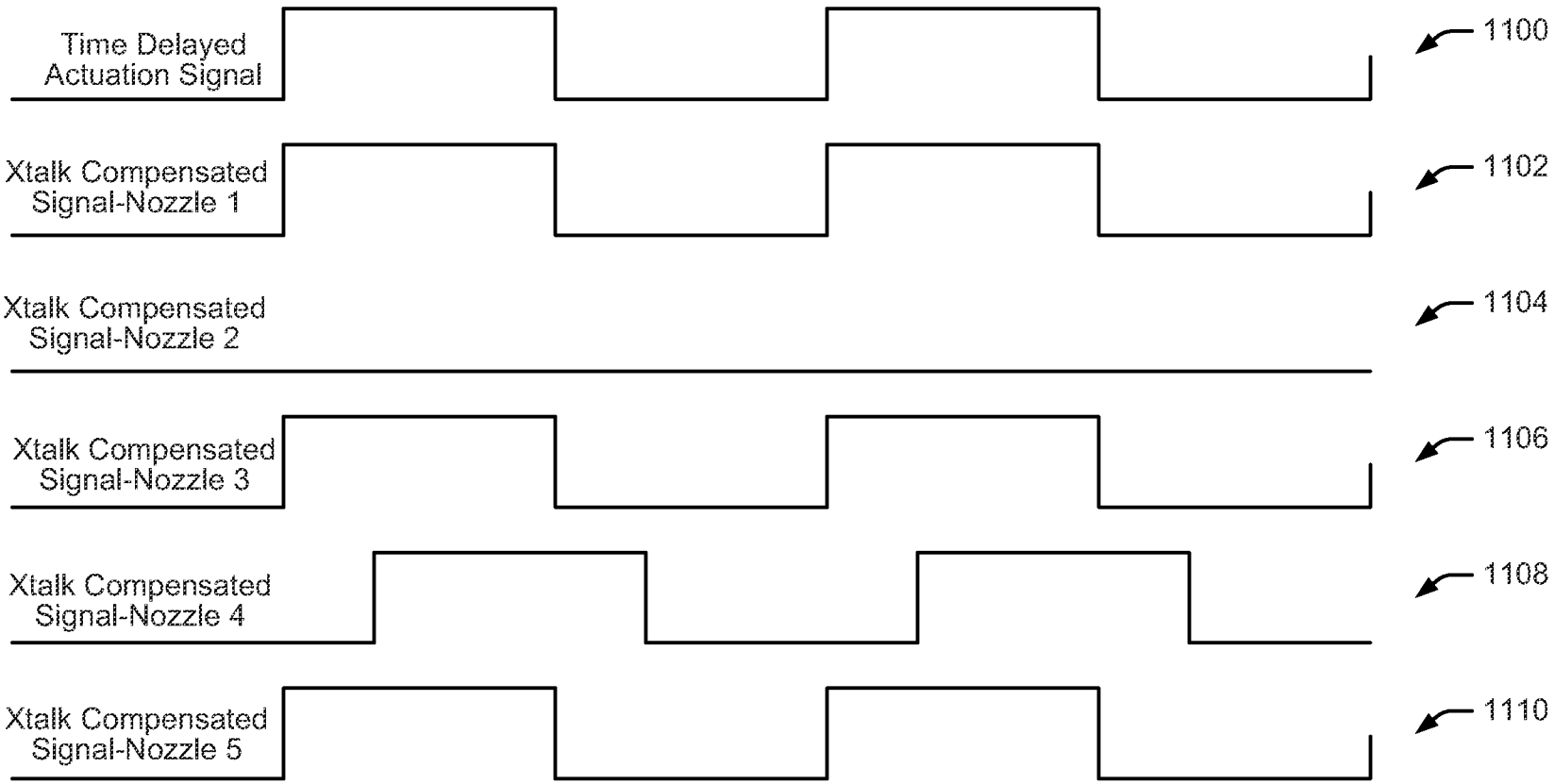
FIG. 11 shows final crosstalk compensated actuation waveforms after the application of both time delay and pulse width adjustments according to an embodiment.

FIG. 11 shows an example of final crosstalk compensated actuation waveforms after the application of both time delay and pulse width adjustments. The example waveforms of FIG. 11 continue the example discussed above with respect to FIG. 7, where the simplified linear 5 nozzle design is assumed, and where the 1st, 3rd, 4th, and 5th nozzles are to fire while nozzle 2 does not fire. In addition, the pulse width extension registers (506) of S0, S1, and S2 contain zero pulse width extension base units, while the S3 register contains 3 pulse width extension base units (for the purpose of this discussion, the pulse width extension base units used in this example are assumed to be unitless, but could otherwise be any appropriate amount of pulse width extension time). The input waveform to the pulse width adjustment element 502 is the time delayed actuation signal 1100 output from the time delay element 500.

Accordingly, referring to FIG. 11 and the pulse width extension element logic flow of FIG. 10, both PND and NND have values of 0 (i.e., PND is 0 because nozzle 1 has no previous neighbor, and NND is 0 because nozzle 2 is not firing). The decision block 1002 of the logic flow of FIG. 10 shows that for the binary firing status of PND=0 and NND=0, the S0 time delay register is used (1010) as the pulse width extension register 506 from which to retrieve the pulse width extension that will be applied to the time delayed nozzle 1 actuation signal. Since the S0 time delay register contains zero pulse width extension base units, the time delayed nozzle 1 actuation signal does not need a pulse width extension. Thus, the resulting crosstalk compensated, nozzle 1 actuation signal 1102 receives no pulse width extension crosstalk compensation and precisely tracks the input time delayed actuation signal 1100.

Continuing on with the waveforms of FIG. 11, since nozzle 2 is not firing, its corresponding crosstalk compensated, nozzle 2 actuation signal 1104 is also not firing. For nozzle 3, the PDN is 0 (i.e., previous neighbor nozzle 2 is not firing) and the NND is 1 (i.e., next neighbor nozzle 4 is firing). Decision block 1004 of the logic flow of FIG. 10 indicates that the S1 pulse width extension register is used (1012) as the pulse width extension register 506 from which to retrieve the pulse width extension that will be applied to the nozzle 3 actuation signal. Since the S1 pulse width extension register contains zero pulse width extension base units, the nozzle 3 actuation signal does not need a pulse width extension. Thus, the resulting crosstalk compensated, nozzle 3 actuation signal 1106 receives no pulse width extension crosstalk compensation and precisely tracks the input time delayed actuation drive signal 1100. For nozzle 4, the PDN is 1 (i.e., previous neighbor nozzle 3 is firing) and the NND is 1 (i.e., next neighbor nozzle 5 is firing). Decision block 1008 of the logic flow of FIG. 10 indicates that the S3 pulse width extension register is used (1016) as the pulse width extension register 506 from which to retrieve the pulse width extension that will be applied to the nozzle 4 actuation signal. Since the S3 pulse width extension register contains three pulse width extension base units, the nozzle 4 actuation signal needs a pulse width extension. Thus, the resulting crosstalk compensated, nozzle 4 actuation signal 1108 receives a three unit pulse width extension crosstalk compensation (Note the extended pulse width in the crosstalk compensated, nozzle 4 actuation signal 1108). For nozzle 5, the PDN is 1 (i.e., previous neighbor nozzle 4 is firing) and the NND is 0 (i.e., since there is no next neighbor, the NND is assumed to be 0). Decision block 1006 of the logic flow of FIG. 10 indicates that the S2 pulse width extension register is used (1014) as the pulse width extension register 506 from which to retrieve the pulse width extension that will be applied to the nozzle 5 actuation signal. Since the S2 pulse width extension register contains zero pulse width extension base units, the nozzle 5 actuation signal does not need a pulse width extension. Thus, the resulting crosstalk compensated, nozzle 5 actuation signal 1110 receives no pulse width extension crosstalk compensation and precisely tracks the input time delayed actuation drive signal 1100.

Figure 12:
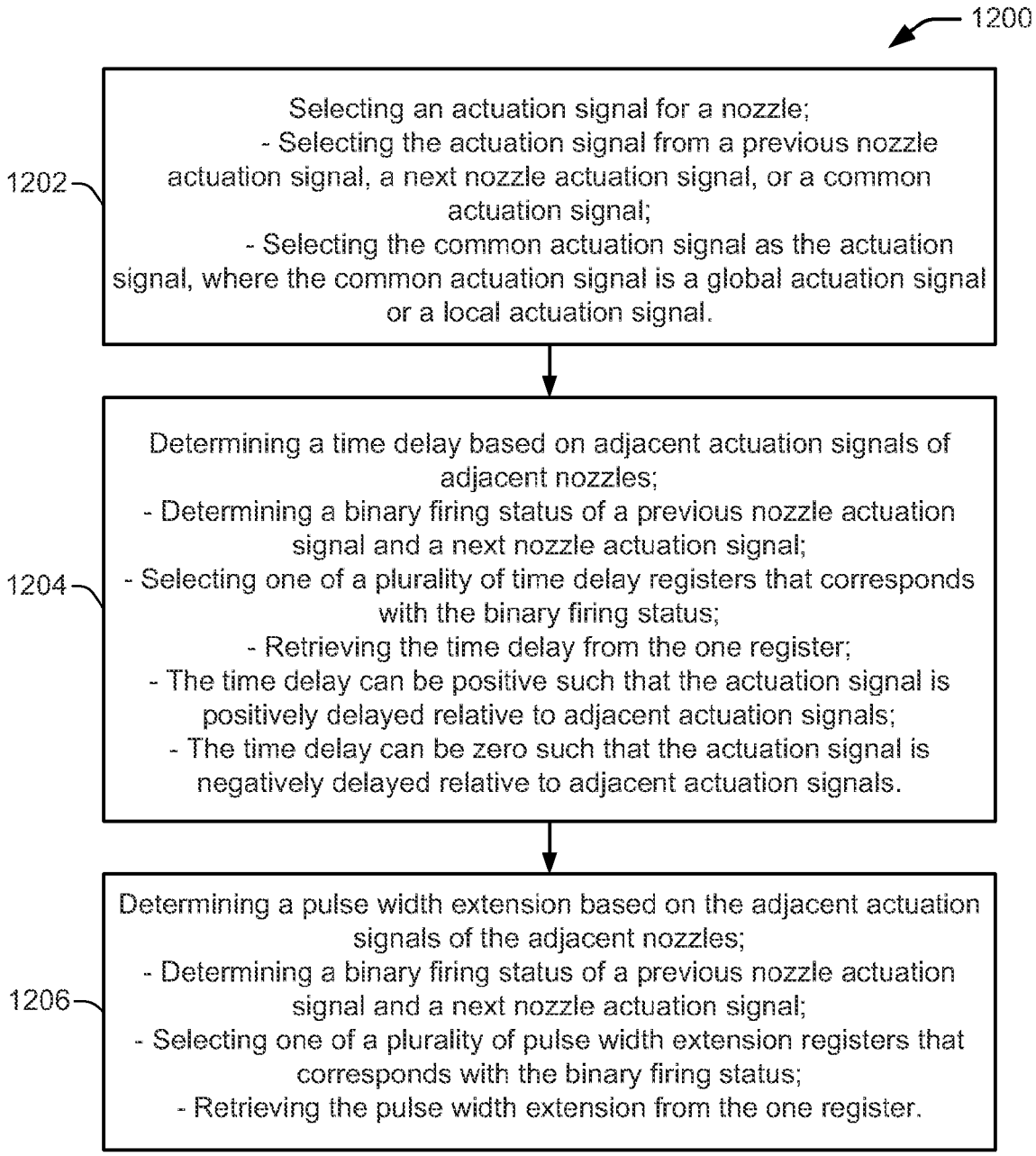
FIG. 12 shows a flowchart of a method of reducing crosstalk in a piezo printhead according to an embodiment.

FIG. 12 shows a flowchart of a method 1200 of reducing crosstalk in a piezo printhead according to an embodiment. Method 1200 is associated with the various embodiments discussed above with respect to FIGS. 1-11. Although method 1200 includes steps listed in certain order, it is to be understood that this does not limit the steps to being performed in this or any other particular order.

Method 1200 begins at block 1202 with selecting an actuation signal for a nozzle. Selecting an actuation signal includes selecting the actuation signal from a previous nozzle actuation signal, a next nozzle actuation signal, or a common actuation signal. Selecting the actuation signal can include selecting the common actuation signal, where the common actuation signal is a global actuation signal or a local actuation signal.

Method 1200 continues at block 1204 with determining a time delay based on adjacent actuation signals of adjacent nozzles. Determining the time delay includes determining a binary firing status of a previous nozzle actuation signal and a next nozzle actuation signal, selecting one of a plurality of time delay registers that corresponds with the binary firing status, and retrieving the time delay from the one register. The time delay can be positive such that the actuation signal is positively delayed relative to adjacent actuation signals. The time delay can be zero such that the actuation signal is negatively delayed relative to adjacent actuation signals.

Method 1200 continues at block 1206 with determining a pulse width extension based on the adjacent actuation signals of the adjacent nozzles. Determining the pulse width extension includes determining a binary firing status of a previous nozzle actuation signal and a next nozzle actuation signal, selecting one of a plurality of pulse width extension registers that corresponds with the binary firing status, and retrieving the pulse width extension from the one register.

What is claimed is:

1. A method to reduce crosstalk in a piezo printhead comprising:

selecting an actuation signal for a nozzle;

determining a time delay and a pulse width extension based on adjacent actuation signals of adjacent nozzles; and applying the time delay and pulse width extension to the actuation signal.

2. A method as recited in claim 1, wherein determining a time delay comprises:

determining a binary firing status of a previous nozzle actuation signal and a next nozzle actuation signal;

selecting one of a plurality of registers that corresponds with the binary firing status; and retrieving the time delay from the one register.

3. A method as recited in claim 1, wherein determining a pulse width extension comprises:

determining a binary firing status of a previous nozzle actuation signal and a next nozzle actuation signal;

selecting one of a plurality of registers that corresponds with the binary firing status; and retrieving the pulse width extension from the one register.

4. A method as recited in claim 1, wherein the time delay is positive and the actuation signal is positively delayed relative to the adjacent actuation signals.

5. A method as recited in claim 1, wherein the time delay is negative and the actuation signal is negatively delayed relative to the adjacent actuation signals.

6. A method as recited in claim 1, wherein selecting an actuation signal comprises selecting a previous nozzle actuation signal, a next nozzle actuation signal, or a common actuation signal.

7. A method as recited in claim 6, wherein selecting an actuation signal comprises selecting the common actuation signal, and wherein the common actuation signal is selected from a global actuation signal and a local actuation signal.

8. A circuit for reducing crosstalk in a piezo printhead comprising:

a time delay element to select a time delay based on actuation signal values of adjacent nozzles and to apply the time delay to an actuation signal of a current nozzle; and a pulse width extension element to select a pulse width extension based on the actuation signal values of the adjacent nozzles and to apply the pulse width extension to the actuation signal of the current nozzle.

9. A circuit as recited in claim 8, further comprising time delay registers from which the time delay element retrieves the time delay and pulse width extension registers from which the pulse width extension element retrieves the pulse width extension.

10. A circuit as recited in claim 8, further comprising a local pulse generator to locally generate the actuation signal for the circuit.

11. A circuit as recited in claim 8, further comprising a previous nozzle actuation signal input, a next nozzle actuation signal input, and a common actuation signal input from which the time delay element selects the actuation signal of the current nozzle.

12. A crosstalk reduction system, comprising:

a piezo printhead having an array of nozzles;

a movable membrane to eject a jetable material through a nozzle by adjusting volume in an associated nozzle chamber;

a piezoelectric material to move the membrane by application of an actuation voltage signal to the piezoelectric material; and a nozzle circuit associated with each of the nozzles, the nozzle circuit including a time delay element to delay the actuation voltage signal based on adjacent actuation voltage signals of adjacent nozzles and a pulse width extension element to extend a pulse width of the actuation voltage signal based on the adjacent actuation voltage signals of the adjacent nozzles.

13. A system as recited in claim 12, the time delay element including logic to determine a binary status of the adjacent actuation voltage signals and to select from a particular time delay register, a time delay used to delay the actuation voltage signal based on the binary status.

14. A system as recited in claim 12, the pulse width extension element including logic to determine a binary status of the adjacent actuation voltage signals and to select from a particular pulse width extension register, a pulse width extension used to extend the pulse width of the actuation voltage signal based on the binary status.

15. A system as recited in claim 12, further comprising an application specific integrated circuit (ASIC), the ASIC comprising:

the nozzle circuit; and a global pulse generator to generate the actuation voltage signal.

16. A system as recited in claim 12, in which the time delay elements selects an actuation signal, the actuation signal selected from a previous nozzle actuation signal, a next nozzle actuation signal, or a common actuation signal.

17. A system as recited in claim 16, in which selecting an actuation signal comprises selecting the common actuation signal, and in which the common actuation signal is selected from a global actuation signal and a local actuation signal.

18. A system as recited in claim 12, wherein the delay of the actuation voltage signal is a positive delay and the actuation voltage signal is positively delayed relative to the adjacent actuation signals.

19. A system as recited in claim 12, wherein the delay of the actuation voltage signal is negative and the actuation voltage signal is negatively delayed relative to the adjacent actuation signals.

20. A system as recited in claim 12, in which the output from the time delay element is the input to the pulse width extension element.

* * * * *